US006427746B1

(12) United States Patent
Anderson et al.

(10) Patent No.: US 6,427,746 B1
(45) Date of Patent: Aug. 6, 2002

(54) LABELING APPARATUS WITH ENHANCED BELLOWS INCLUDING FLEXIBLE COIL TUBE AND ASSOCIATED METHOD

(75) Inventors: David N. Anderson, Auburndale; Wayne C. Sherman, Lakeland, both of FL (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/187,441

(22) Filed: Nov. 6, 1998

Related U.S. Application Data

(63) Continuation-in-part of application No. 09/046,219, filed on Mar. 23, 1998.

(51) Int. Cl.[7] ..... B65C 9/00; B65C 9/08; B65C 9/18

(52) U.S. Cl. ..... 156/541; 156/538; 156/567; 156/568; 156/DIG. 38; 221/211

(58) Field of Search ..... 156/285, 497, 156/541, 542, 567, 568, 571, 572, 538, 351, 363, 358; 198/471.1, 803.5; 221/73, 211; 222/1, 3, 64

(56) References Cited

U.S. PATENT DOCUMENTS

| | | | | |
|---|---|---|---|---|
| 3,318,468 A | | 5/1967 | Olson | 214/650 |
| 3,450,590 A | | 6/1969 | LaMers | 156/540 |
| 4,547,252 A | | 10/1985 | LaMers | 156/497 |
| 4,581,094 A | * | 4/1986 | Sato | 156/352 |
| 5,645,680 A | * | 7/1997 | Rietheimer | 156/567 |

FOREIGN PATENT DOCUMENTS

| | | | |
|---|---|---|---|
| AT | 267128 | 10/1968 | |
| EP | 0 113 256 | 7/1984 | B65C/9/18 |
| GB | 11129386 | 11/1966 | B66C/1/02 |
| WO | 88/03462 | 5/1988 | B25J/15/06 |

* cited by examiner

*Primary Examiner*—Richard Crispino
*Assistant Examiner*—Sue A. Purvis
(74) *Attorney, Agent, or Firm*—Leydig, Voit & Mayer, Ltd.

(57) ABSTRACT

A labeler includes at least one bellows movable between extended and retracted positions. The bellows includes a cap defining a distal end for carrying the label and having at least one cap opening therein, and a pleated sidewall connected to the cap. The labeler includes a flexible coil tube positioned within the bellows and having a distal end connected in fluid communication with the cap openings and a proximal end for being connected to negative and positive fluid pressure, respectively. A positioner advances the bellows along a path of travel between a label pick-up position and a label application position. A pressure controller selectively connects the bellows and the proximal end of the flexible coil tube to negative and positive fluid pressures as the bellows is advanced along the path of travel. The pressure controller may, during a first time, connect the bellows to positive fluid pressure while connecting the proximal end of the flexible coil tube to negative pressure to retain the label as the at least one bellows is moved to the extended position. The pressure controller may also, during a second time period after the first time period, connect the proximal end of the flexible coil tube to positive fluid pressure while connecting the at least one bellows to negative fluid pressure so as to expel a label not applied to an article as the bellows is moved to the retracted position.

19 Claims, 14 Drawing Sheets

LABELING APPARATUS WITH ENHANCED BELLOWS INCLUDING FLEXIBLE COIL TUBE AND ASSOCIATED METHOD

RELATED APPLICATION

The present application is a continuation-in-part application of Ser. No. 09/046,219 filed Mar. 23, 1998, the entire contents of which are incorporated by reference.

FIELD OF THE INVENTION

This invention relates to the field of labeling, and, more particularly, to a labeling apparatus and associated method, such as for the application of labels to fruit and/or vegetables.

BACKGROUND OF THE INVENTION

Labels are applied to fruit and vegetables in packing houses, where the speed at which the labels are applied, the accuracy of the label application, and the space required by the labeler, i.e. the labeler footprint, are important. Speed is important because the fruit must be packed and shipped quickly so that the shelf life in stores will be as long as possible and the speed of the labeler may be a limiting constraint. This constraint of labeler speed may also result in inefficient use of other equipment and personnel in the packing house, thus increasing the overall cost of operation.

Accuracy, in the form of the successful application of the proper label to the fruit, is important because packing house profitability is adversely affected when a label that would have permitted a higher selling price is not applied to fruit otherwise capable of commanding such a higher price. Space is also important because of the physical configuration of any given packing house. The fruit is transported in a series of lanes, each lane conveying fruit on a plurality of cradles connected to an endless belt, each cradle supporting and locating an individual fruit. The fruit in each lane is sized by conventional sizing equipment and subsequently conveyed past a plurality of labelers arranged in series or banks, each of the labelers in the series of labelers being loaded with a different label, i.e. a label imprinted with indicia to identify the size of the fruit. The physical arrangement of the packing house often limits, without major reconstruction of the building, the number of banks of labelers it is possible to install.

U.S. Pat. No. 4,547,252 to LaMers discloses a labeling apparatus, such as for fruit, and including an extendable bellows for placing the labels. The bellows is moved past a magazine or cassette which dispenses the labels from a carrier strip. The labels are held in position on the distal end of the bellows by application of a vacuum to the bellows, which also serves to maintain the bellows in a retracted position. As the bellows is moved to an application position adjacent a fruit, positive pressure is applied and the bellows is extended to contact the fruit and apply the label thereto.

As also disclosed in the patent, a tricuspid check valve is integrally formed on the distal end of the bellows. The valve admits air from outside the bellows to the interior of the bellows, but prevents the flow of air out of the bellows. Accordingly, in theory, the label may be held in position by the vacuum applied to maintain the bellows in the retracted position. When the bellows is extended by positive air pressure, the valve in theory is closed to prevent blowing the label off of the end of the bellows and thereby missing the fruit.

Unfortunately, the integrally formed check valve may become gummed with adhesive from the adhesive labels or from wax carried by the fruit. If the valve becomes stuck open, when positive pressure is applied, the label may be ejected prematurely. If the valve becomes gummed in a closed position, the bellows may not pick up the labels and the dispensing cassette may jam thereby requiring maintenance.

Published European patent application 113,256 assigned to Sinclair discloses a labeler including a plurality of extendable bellows rotated between label pick-up and label applying positions. In a related commercial embodiment of the Sinclair labeler, a flexible diaphragm has been used in place of the tricuspid check valve. The flexible diaphragm is secured to the inside distal end of the bellows. When a vacuum is applied, the diaphragm opens to expose a series of openings in the distal end. Accordingly, the label is held in position by vacuum communicated to the end openings. When positive pressure is applied to extend the bellows, the flexible diaphragm desirably seals against the openings.

Unfortunately, the diaphragm arrangement may be subject to the same shortcomings as the tricuspid check valve. In other words, the accumulation of adhesive and/or wax could stick the diaphragm in either the opened or closed positions. Accordingly, fruit may not be properly labeled, and additional maintenance may be required for the labeler.

U.S. Pat. No. 3,450,590 to LaMers discloses a labeler including a reciprocating bellows movable between retracted and extended positions for applying labels to passing objects. A central pipe extends through the interior of the bellows. A very slight vacuum is applied to the pipe to just hold the label to the opening of the pipe at the end of the bellows. Unfortunately, the central pipe may interfere with the reciprocating movement of the bellows. In addition, the slight vacuum applied by the pipe may be insufficient to retain the label, especially if the adhesive clogs a portion of the end of the pipe. The constant supply of vacuum may also result in the accumulation of adhesive and debris on the end and into the interior of the pipe.

SUMMARY OF THE INVENTION

In view of the foregoing background, it is therefore an object of the present invention to provide a labeling apparatus and associated methods that include one or more bellows that can effectively apply a vacuum to hold a label in position, that properly place the labels on the fruit, and yet which are also resistant to clogging from the label adhesive or fruit wax.

These and other objects, features and advantages in accordance with the present invention are provided by a labeling apparatus comprising at least one bellows being movable between extended and retracted positions responsive to positive and negative internal fluid pressure, respectively, and including a flexible coil tube within the bellows. The bellows preferably includes a cap defining a distal end for carrying the label and has at least one cap opening therein. A pleated sidewall may be connected to the cap. The flexible coil tube preferably has a distal end connected in fluid communication with the cap openings and a proximal end for being connected to negative and positive fluid pressure, respectively. Accordingly, the label can be retained as desired by applying a vacuum, and debris, such as a stuck label or accumulated adhesive may be cleared from the cap openings.

In one embodiment, a positioner advances the bellows along a path of travel between a label pick-up position and a label application position. A pressure controller selectively connects the bellows and the proximal end of the flexible coil tube to negative and positive fluid pressures as the bellows is advanced along the path of travel.

The pressure controller may include means for, during a first time, connecting the bellows to positive fluid pressure while connecting the proximal end of the flexible coil tube to negative pressure to retain the label as the bellows is moved to the extended position. The controller may also include means for, during a second time period after the first time period, connecting the proximal end of the flexible coil tube to positive fluid pressure while connecting the bellows to negative fluid pressure. This will serve to expel debris or a label not applied to an article as the bellows is moved to the retracted position. Accordingly, the flexible coil tube may be used to apply vacuum to hold the label against the end of the bellows, and to apply positive pressure to clear the cap openings, such as to expel a stuck label.

The labeling apparatus may further comprise a rotatable frame, and a plurality of bellows may be mounted on the rotatable frame. In this embodiment, the positioner rotates the rotatable frame to position the plurality of bellows.

Considered in somewhat different terms, the labeler in some embodiments may include a fluid pressure manifold defining at least one negative pressure port and at least one positive pressure port therein. The rotatable frame surrounds the fluid pressure manifold and has a series of spaced apart first and second openings therein. The bellows are carried by the rotatable frame so that each bellows is connected to a corresponding first opening in the rotatable frame. Accordingly, as the rotatable frame rotates in registry with the respective manifold ports, the bellows is movable between extended and retracted positions responsive to coupling to positive and negative fluid pressure, respectively.

The respective flexible coil tube positioned within each bellows has a distal end connected in fluid communication with the cap openings and a proximal end connected separately from the bellows to a corresponding second opening in the rotatable frame. Thus, rotation of the rotatable frame about the fluid pressure manifold advances each of the bellows along a path of travel between a label pick-up position and a label application position, and selectively aligns the respective pressure ports with the second openings in the rotatable frame so that each flexible coil tube is connected to negative pressure at at least the label pick-up position.

Coils of the flexible coil tube preferably define a longitudinal axis extending along a direction of extension and retraction of the bellows. The flexible coil tube also preferably includes a material having a shape memory so that the flexible coil tube biases the at least one bellows toward the retracted position. Coils of the flexible coil are preferably positioned within a rigid mounting cup when the bellows is in the retracted position.

A partition member may be positioned in an interior portion of the bellows adjacent the distal end thereof to define a distal end chamber in fluid communication with the cap openings. The distal end of the flexible coil tube may be connected in fluid communication with the distal end chamber. In addition, stop means may be provided within the distal end chamber for defining a first positive stop between the partition member and the cap. A second positive stop may be provided by outermost portions of the rigid mounting cup contacting the partition member when the bellows is in the retracted position.

One method aspect of the invention is for making a label applying apparatus comprising at least one bellows movable between extended and retracted positions responsive to positive and negative fluid pressure. The at least one bellows preferably comprises a cap defining a distal end for carrying the label and having at least one cap opening therein, and a pleated sidewall connected to the cap. The method preferably comprises the steps of forming a flexible coil tube, positioning the flexible coil tube within the at least one bellows, and connecting a proximal end of the flexible coil tube in fluid communication with the at least one cap opening.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The bellows in accordance with the present invention is best appreciated after an initial explanation of the overall labeling apparatus 10. This apparatus is further described in U.S. patent application Ser. No. 08/863,036 filed May 23, 1997 the entire disclosure of which is incorporated herein by reference.

Figure 1:
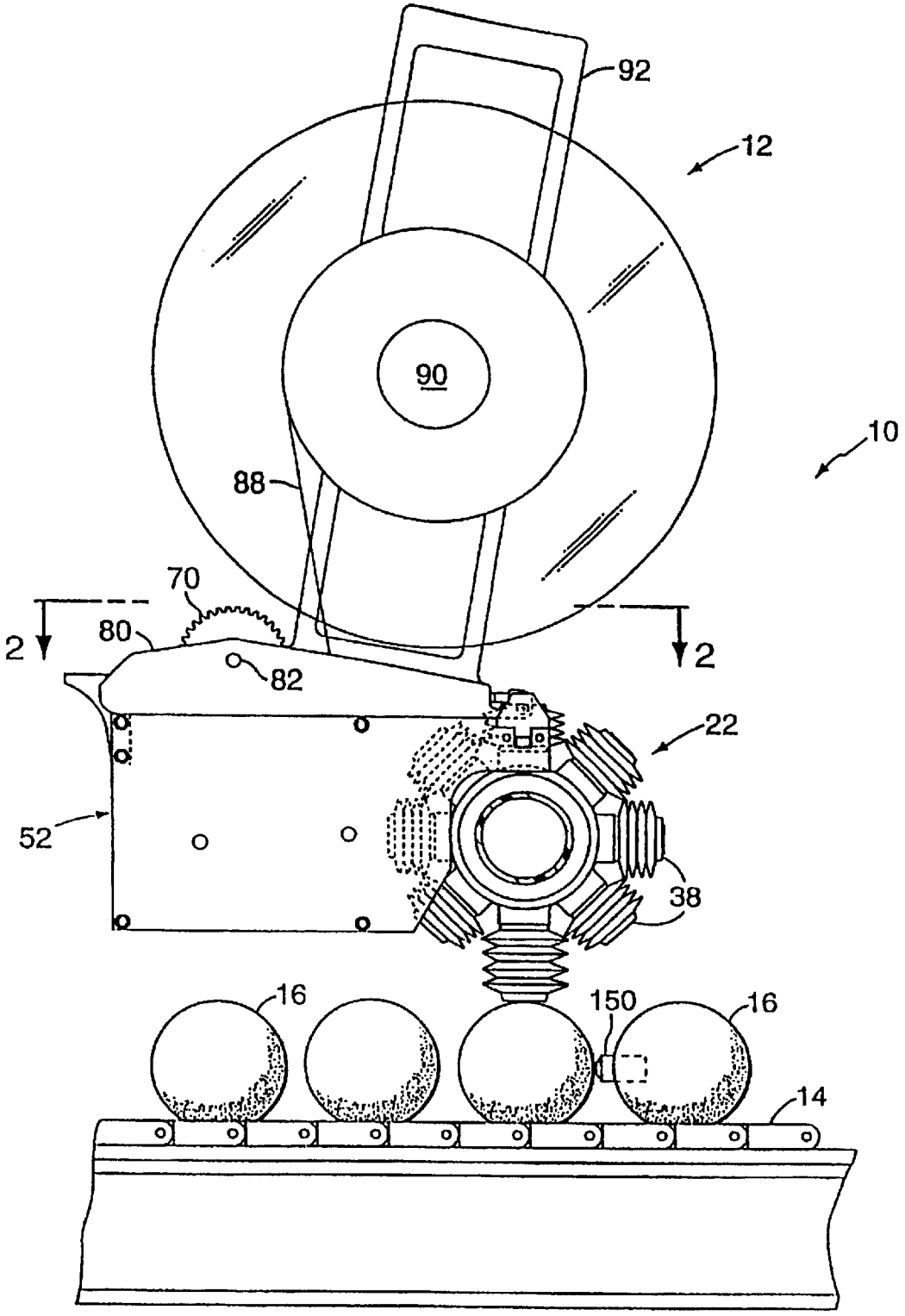
FIG. 1 is a side elevational view of a labeler, with the label cassette installed, according to the present invention.
Figure 2:
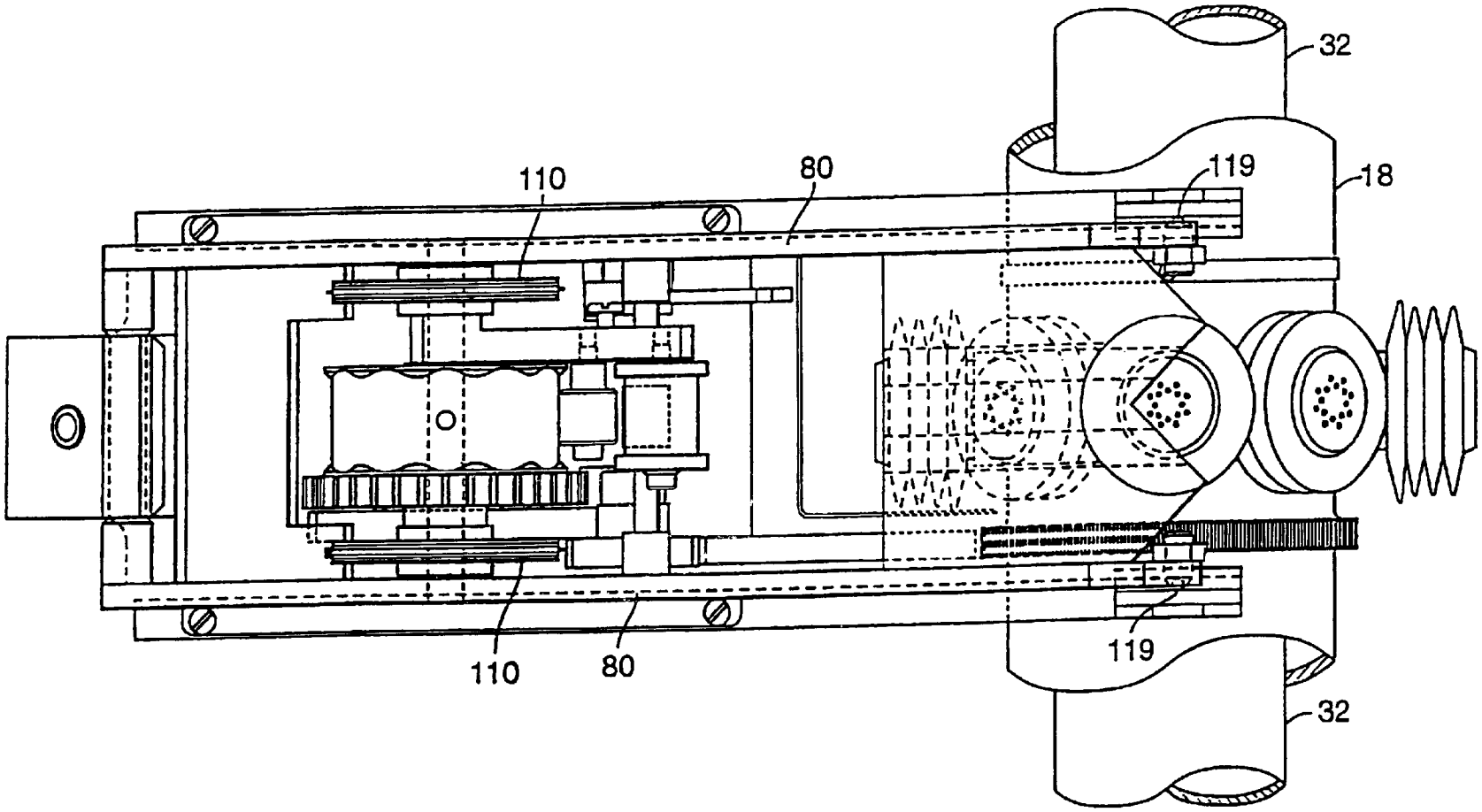
FIG. 2 is a cross-sectional view, taken along line 2—2 of FIG. 1.
Figure 3:
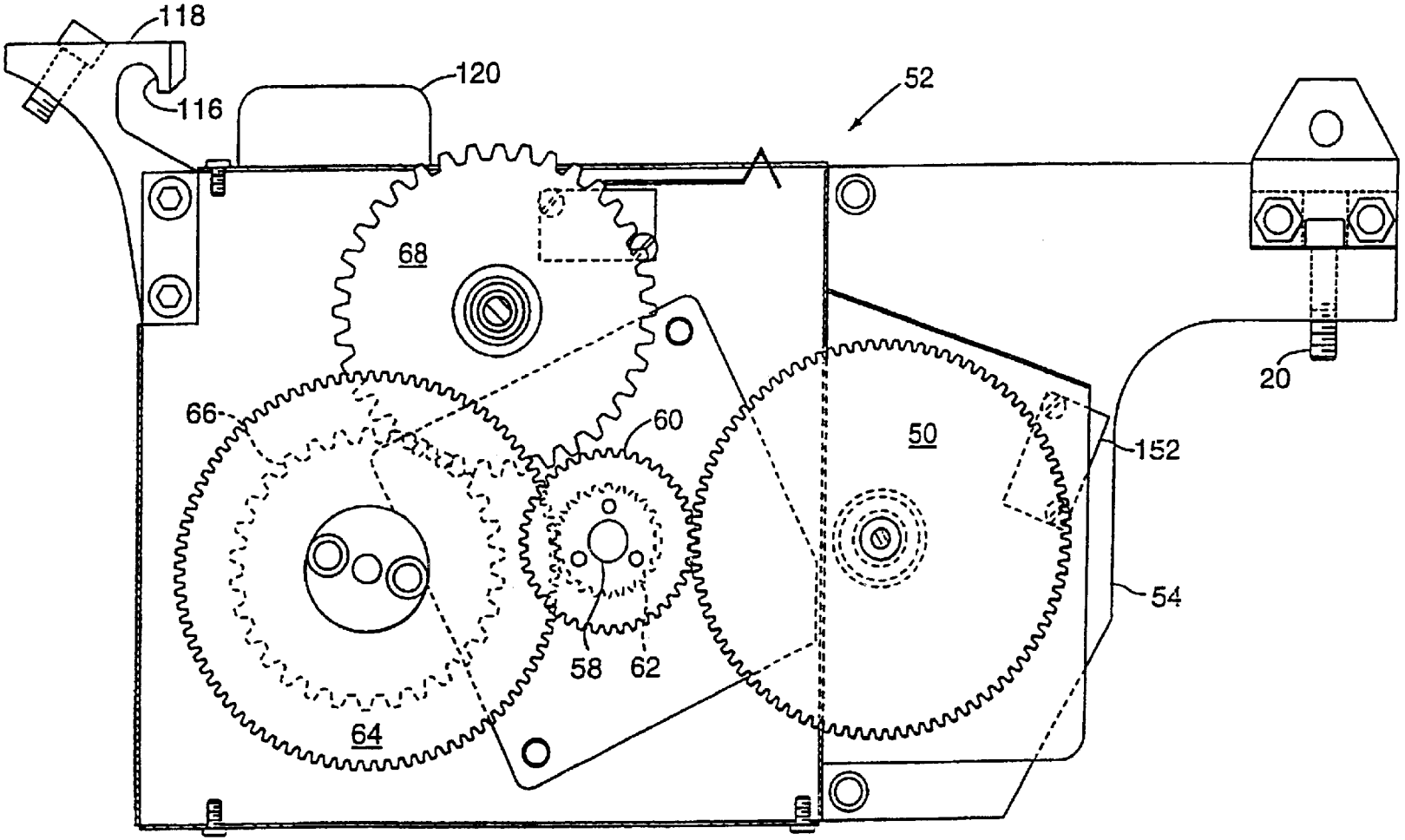
FIG. 3 is a side elevational view, partly in section with parts broken away and eliminated, of the drive train for the labeler of FIG. 1.
Figure 4:
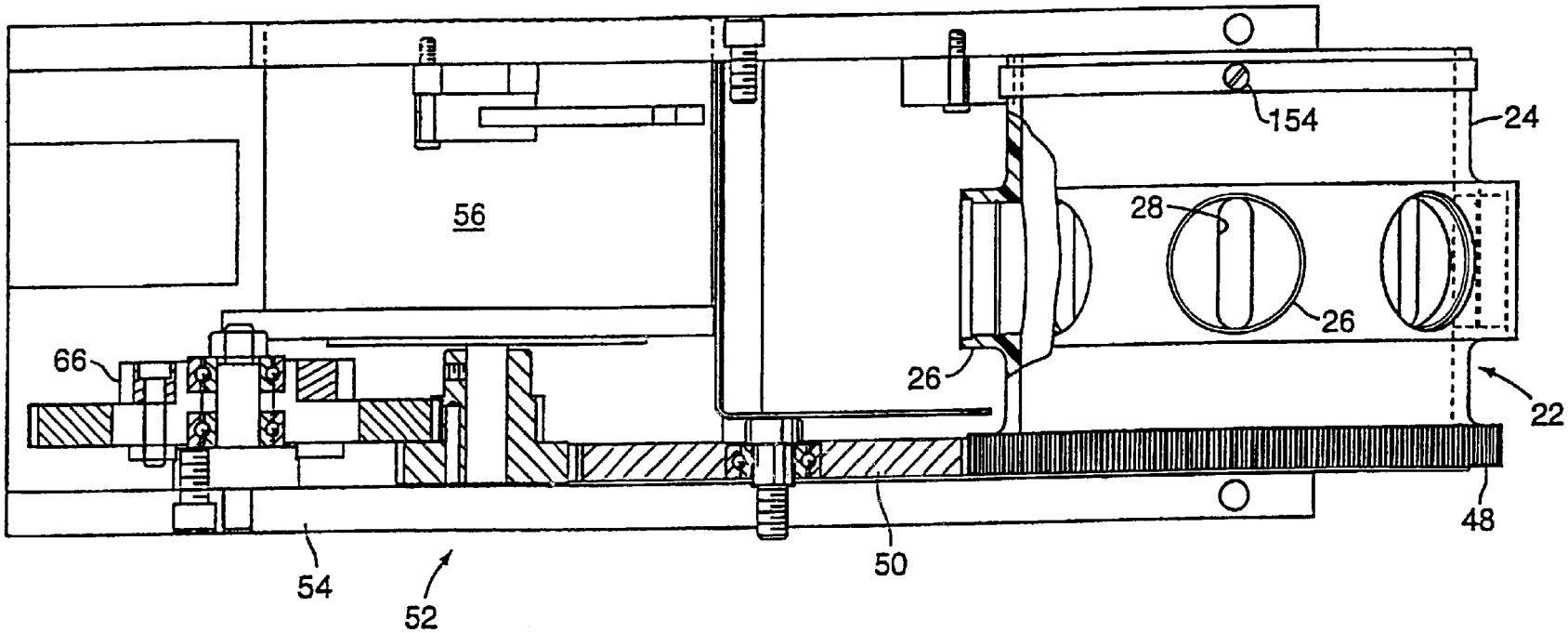
FIG. 4 is a top plan view, partly in section, of the labeler shown in FIG. 1 with the label cassette removed.
Figure 5:
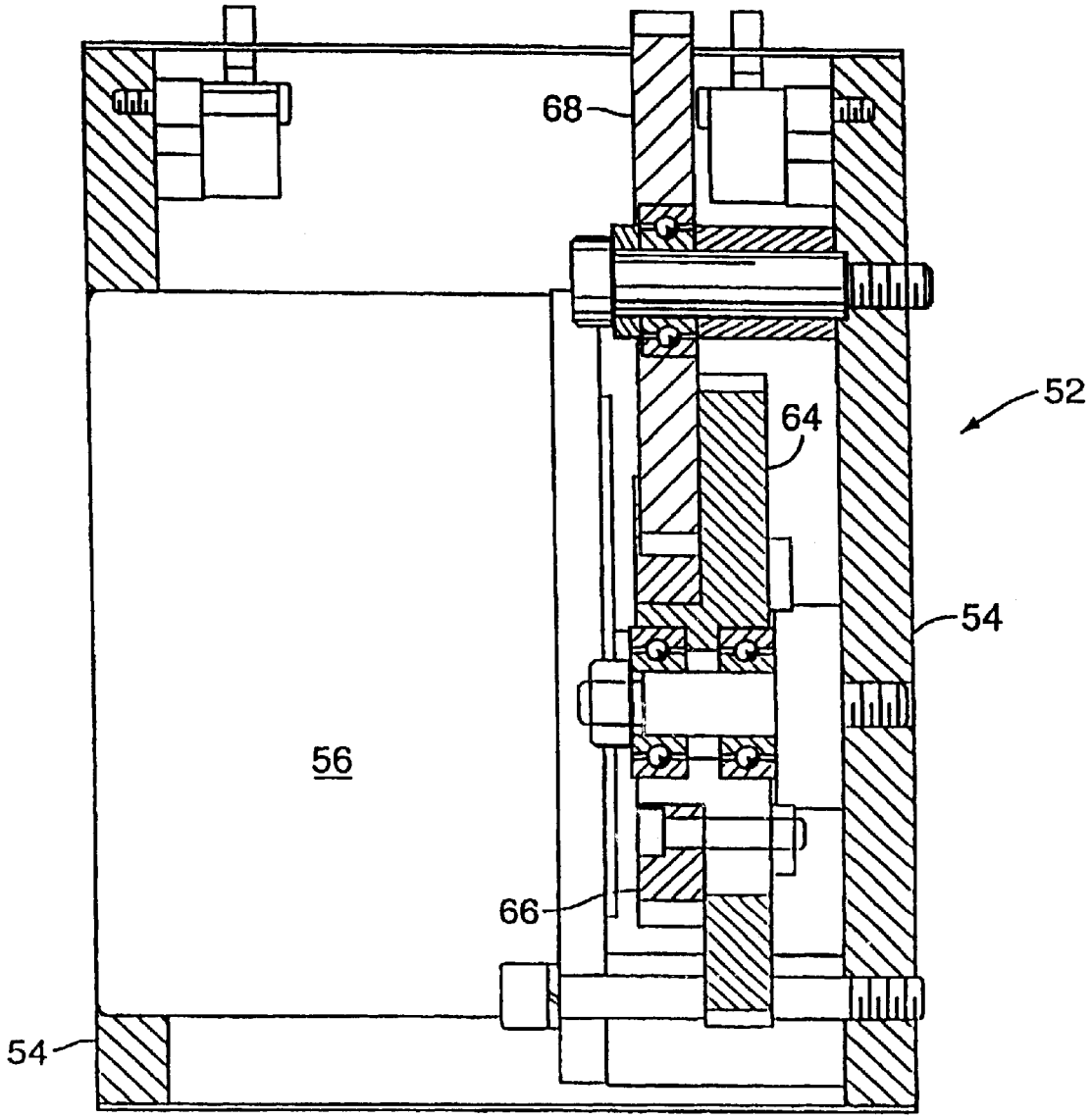
FIG. 5 is an elevational end view of the labeler shown in FIG. 1.
Figure 6:
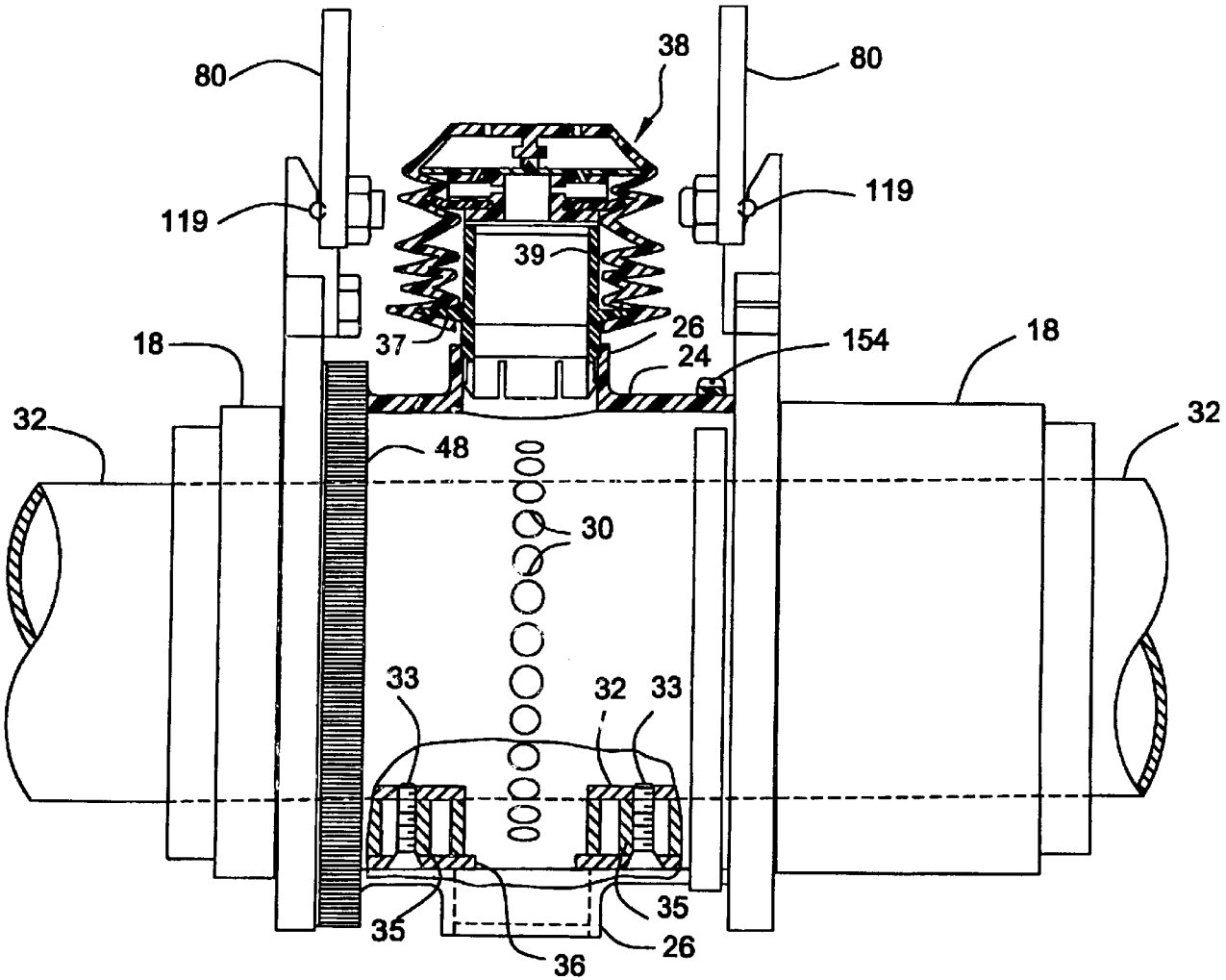
FIG. 6 is a top plan view of a portion of the labeler shown in FIG. 1 showing the bellows wheel.
Figure 7:
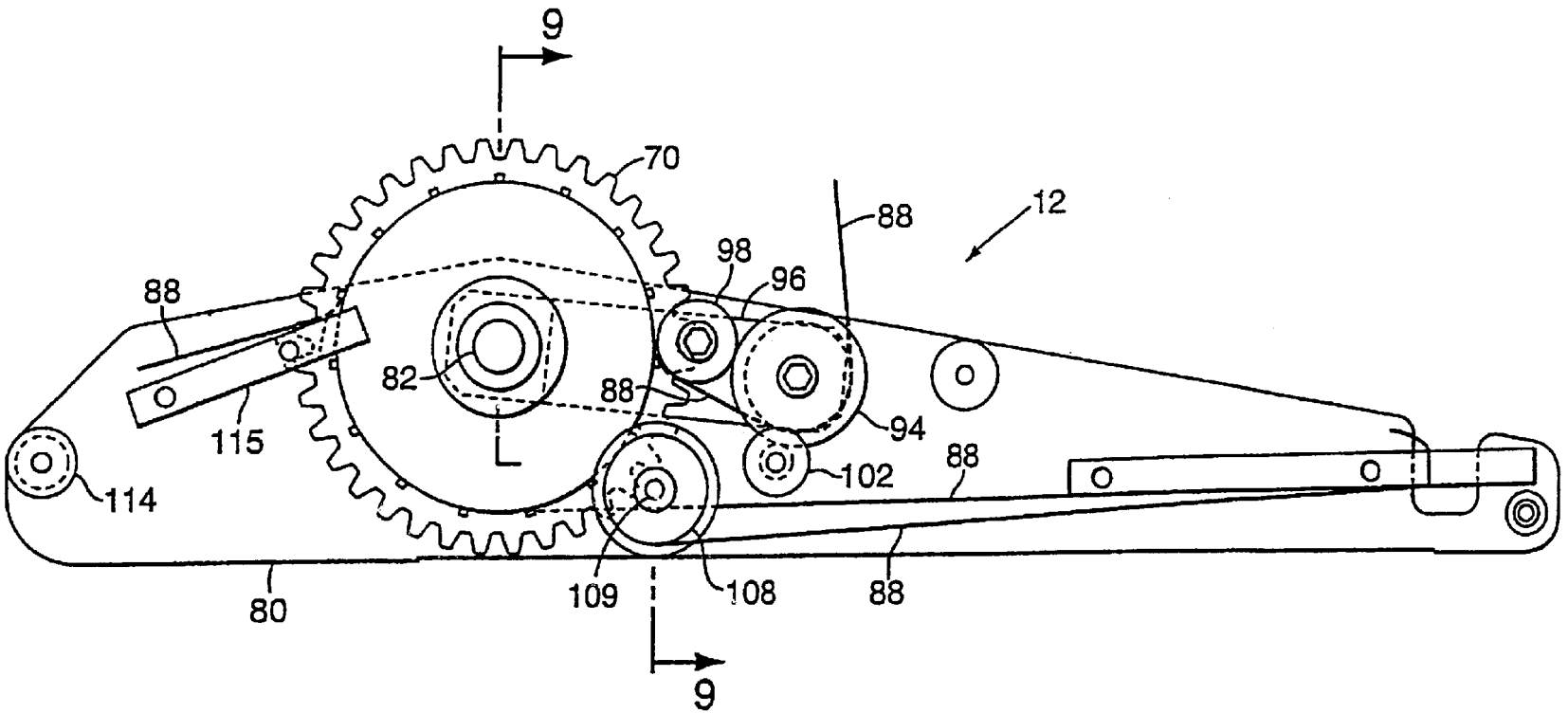
FIG. 7 is a side elevational view of the label cassette for the labeler of FIG. 1.
Figure 8:
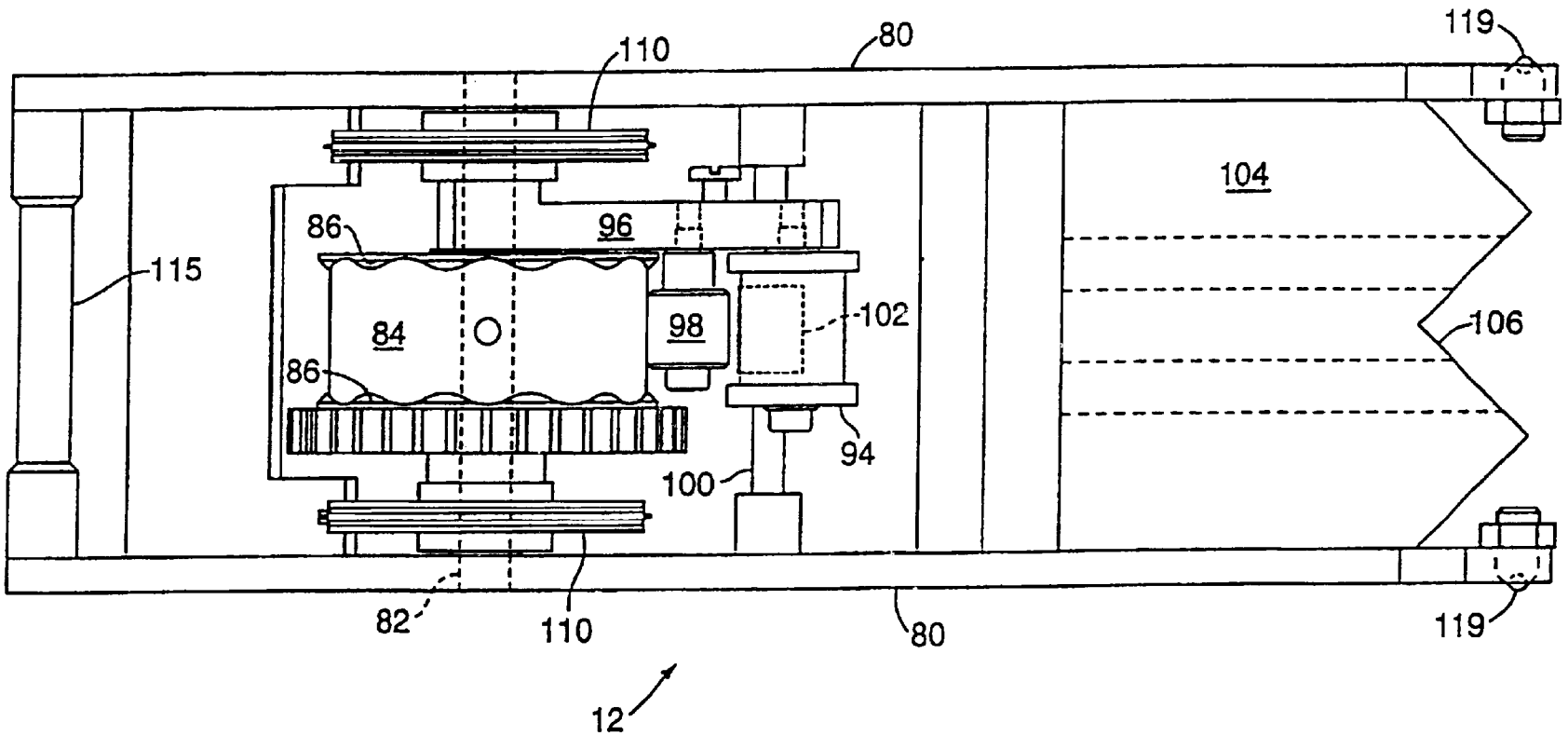
FIG. 8 is a top plan view of the label cassette shown in FIG. 7.

Referring now to FIG. 1, the labeler 10 includes a label cassette 12 in engagement therewith, supported over a conveyor 14 having conventional cradles for holding and positioning individual fruit 16. The means of such support is through attachment to a vacuum tube 18 by bolts 20 as can be seen in FIG. 3. As best seen from FIGS. 4 and 6, a bellows wheel 22 includes a tubular portion 24 which is rotatable on and sealingly engageable on its ends with the vacuum tube 18. Eight cylindrical projections 26 are provided around the periphery of the tubular member 24 and are positioned with their centers spaced 45 degrees from each other. Each of the cylindrical projections 26 is provided with slot 28 to permit communication with the tube 18, which tube is provided with a plurality of equally spaced radial holes 30 and is connected with a vacuum source.

For ease of manufacture, the vacuum tube 18 is composed of multiple sections joined together and suspended from a pressure tube 32 extending along the interior of the vacuum tube 18. The suspension is by means of bolts 33 extending though the vacuum tube 18 and engaging tapped holes in the pressure tube 32, with spacers 35 maintaining the proper distance between the two tubes 18 and 32. The pressure tube 32 is connected to a source of air pressure, which may be a conventional blower.

For convenience and economy, the source of vacuum for the tube 18 may be the inlet side of the blower supplying air pressure to the tube 32. A cross tube 34 is connected, and communicates air pressure, between the pressure tube 32 and a slot 36 in the vacuum tube 18 at the six o'clock position. The width of the slots 28 in the projections is wider than the space between the holes 30 so that vacuum is always available to each projection 26, except when the projection is at the six o'clock position. As the slot 28 for each projection 26 rotationally approaches that position, vacuum access is interrupted and communication with the pressure slot 36 is initiated.

Similarly, as each projection rotationally leaves the 6 o'clock position, pressure is cut-off just before access to vacuum is permitted. The purpose of this arrangement for vacuum and pressure is to control the timing for extension and retraction of a flexible bellows 38 provided for each of the projections 26.

Each of the bellows 38 is retained by a outward projecting flange 37 on a relatively rigid cup 39 having a slotted end for insertion into a cylindrical projection 26. A lip formed on the slotted end snaps into an internal groove in the projection 26 to releaseably retain the cup 39 in place. Holes in the outer end of the cup 39 communicate pressure or vacuum in the projection 26 to the associated bellows 38. The cup 39 also functions to limit the amount of collapse for the associated bellows when subjected to vacuum. Thus, the bellows 26 are contracted throughout the rotation of the tubular member 24 except when in proximity to the six o'clock position. It is in that position that each of the bellows is extended toward the fruit to effect the application of a label thereto.

The bellows wheel 22 is intermittently rotated by a gear 48 formed on one end of the tubular member 24, which gear meshes with a bellows drive gear 50. A drive assembly, indicated generally at 52, which includes a housing 54 in which the gear 50 is rotatably mounted. A stepper motor 56 is mounted within the housing 54 and has an output shaft 58 with a drive gear 60 attached thereto, which gear 60 meshes with the bellows drive gear 50. A second drive gear 62 is also attached to the output shaft 58 and meshes with an idler gear 64 rotatably mounted in the housing 54.

An idler sprocket 66 is attached to the idler gear 64 and meshes with a cassette drive sprocket 68. The sprocket 68 is rotatably mounted in the housing 54 with its teeth projecting through and above a protective cover secured to the top of the housing to engage the sprocket 70 carried by the cassette 12. In order to accommodate labels of different sizes, the sprocket 66 is removably secured to the gear 64 by bolts 72 so that a sprocket with the number of teeth necessary to advance the label carrier the proper distance may be installed.

The stepper motor 56 is mounted in the housing so that its output shaft 58 is between the rotational mountings of the bellows drive gear 50 and the idler gear 64 and idler sprocket 66, and the rotational mounting of the cassette sprocket is above and between the output shaft and the rotational mountings of the idler gear 64 and idler sprocket 66. This arrangement produces a compact footprint for the labeler 10.

As shown in FIGS. 1 and 7–9B, the cassette 12 has a frame 80 with a shaft 82 rotatably mounted therein. The cassette sprocket 70 is affixed to the shaft 82 as is a hub 84 which is centered on the frame. The hub 84 has a depressed center section with sinusoidal side walls 86 projecting toward and away from each other. The edges of the carrier 88 are formed with a shape complementary to and engageable with the sinusoidal side walls 86. The carrier 88 is wound on a shaft 90 which is rotatably supported on handles 92 formed on and extending upward from the frame 80. The carrier 88 is trained around a guide pulley 94 rotatably carried on a tension arm 96 which is loosely carried by the shaft 82.

A second roller 98 rotatably carried by the arm 96 assures the carrier 88 engages the side walls 86. A stepped shaft 100 extends across and is non-rotationally secured to the frame 80. A full diameter section 102 of the shaft 100 is engageable by the guide roller 94 to assure the carrier remains within the side walls thereof. The full diameter section 102 also limits the downward travel of the guide roller 94, which is biased downward by gravity, to trap the carrier 88 therebetween and arrest the carrier's momentum and to maintain tension therein.

A plate 104 having a V-shaped notch 106 is attached to the frame 80 to split the carrier 88, which is weakened along its centerline for that purpose, and to separate the labels from the carrier as the carrier passes over the notch 106. Each half of the separated carrier passes underneath the plate 104 and around guide rollers 108 rotatably mounted on the frame 80. Each half passes between the rollers 108 and pin wheels 110, passing over the top of the pin wheels 110, which are rotated in a counter-clockwise direction as viewed in FIG. 7. The pin wheels 110 are provided with protruding sharp pins 111 which penetrate the associated half of the carrier, the penetration being aided by a groove 113 in the guide rollers 108.

Each of the pin wheels 110 is mounted by conventional roller clutches 112 on the shaft 82. The clutches 112 permit the pin wheels to free-wheel in a counter-clock wise direction as viewed in FIG. 7, which is the direction the shaft 82 rotates when it is being driven, but do not permit rotation of the pin wheels in a clockwise direction so that tension is maintained on each half of the carrier 88 without causing separation thereof. A wedge 115 secured to the inside of each side of the frame 80 separates the halves of the carrier 88 from the pins 111 on the associated pin wheel 110.

Figure 9A:
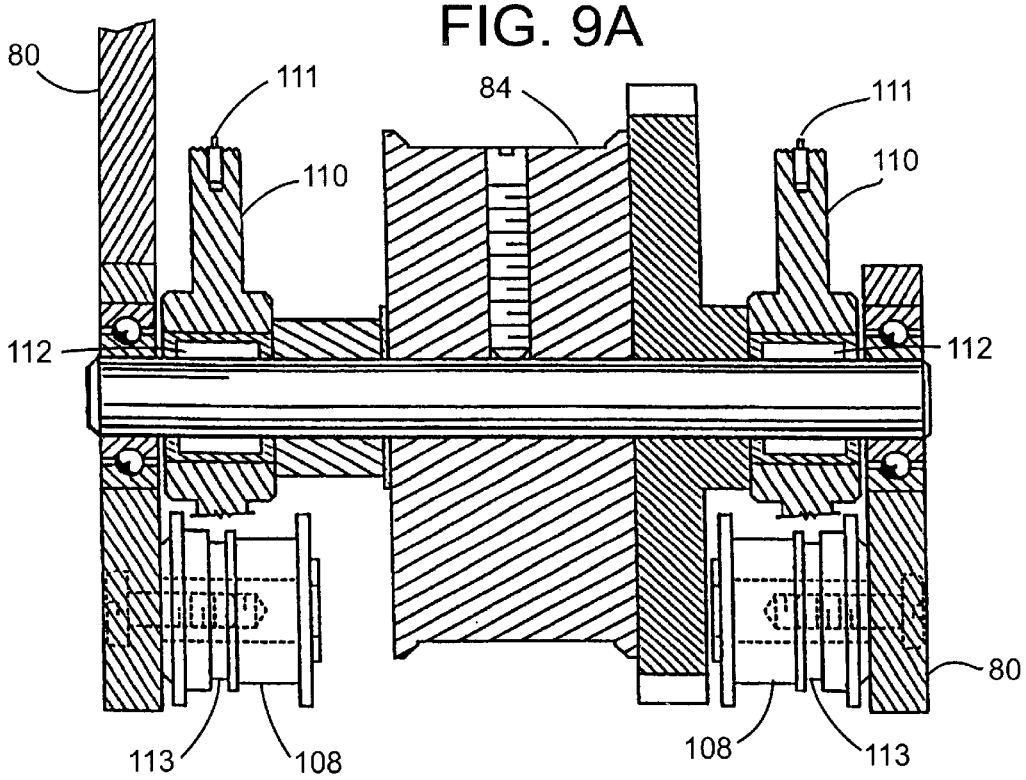
FIG. 9A is a cross-sectional view taken along line 9—9 of FIG. 7.
Figure 9B:
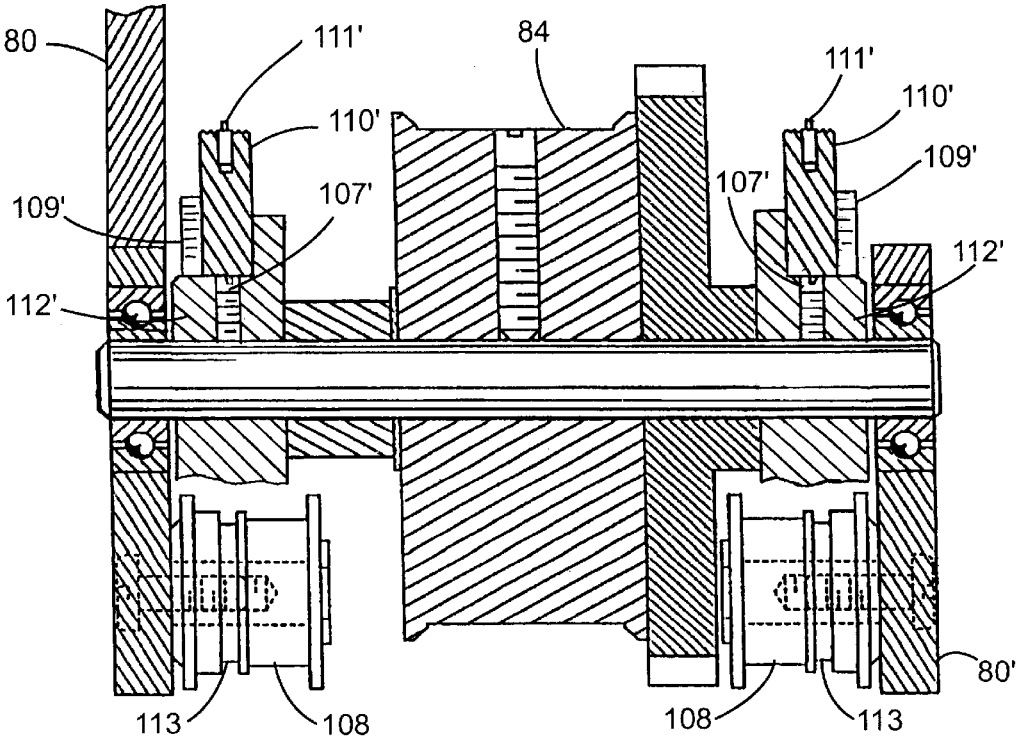
FIG. 9B is a cross-sectional view of an alternate embodiment of take-up pinwheels and hubs as shown in FIG. 9A.

In another embodiment, the one-way clutches 112 of FIG. 9A may be replaced by hubs 112' which are locked to the shaft by set screws 107' as shown in FIG. 9B. The pinwheels 110' are releasably secured to the hubs 112' by rotatable locking nuts 109' as will be readily understood by those skilled in the art. Releasing the locking nut 109' permits the pinwheel 110' to rotate freely in both directions to permit initial threading of the halves of the carrier 88.

A bar 114 spans one end of the frame 80 and is engageable with a hook 116 formed in the bracket 118 (See FIG. 3). The bracket 118 is secured to the frame 54 of the drive assembly 52. The bar 114 has enlarged diameter ends, the transitions to which tends to center the bar 114 on the bracket 118 and the drive assembly 52 as the bar 114 is positioned under the hook 116, as do the guides 120 formed on the top cover for the frame 54. A spring-loaded detent 119 is mounted on each side of the cassette frame 80 and engages a recess on the frame 54 to releaseably retain the cassette in place on the drive assembly (See FIGS. 6 & 8). The cassettes are interchangeable so that one cassette can be loaded off-line with a reel of a carrier bearing labels while another cassette is operatively engaged with the labeler 14 to apply labels to the fruit.

The stepper motor 56 is activated or energized for rotation of its output shaft 58 by a fruit sensing switch 150 positioned beside the conveyor 14 to detect the approach of a fruit in a cradle on the conveyor. Once energized, the stepper motor 56 accelerates from standstill to a rotational speed which causes the velocity of the end of the bellows 38 to match that of the conveyor 14, which may be determined by counting the rotations of an idler sprocket (not shown) engaging the conveyor, and then decelerates to a standstill. The acceleration or ramp-up of the motor 56 from a standstill, which is initiated by closing of sensing switch 150, is a function of the speed of the conveyor 14, the distance between the cradles thereon carrying the fruit, and the maximum tensile force to which the carrier 88 may be subjected.

A proximity switch 152 mounted on the frame 54 detects the head of a plurality of small metal screw 154 secured to the bellows wheel 22, with each screw 154 being positioned adjacent one of the projections 26. The deceleration or ramp-down is initiated by the proximity switch 152 closing upon the approach of the next head of screw 154 and is a mirror image of the acceleration.

Activation of the motor 56 causes the gears 60 and 62 to be rotated in a clockwise direction as viewed in FIG. 3, which results in both the bellows wheel 22 and the cassette drive sprocket 68 being driven in the same direction. Because there is a direct connection between the drive of both the bellows wheel and the cassette, a full bellows cycle, i.e. the full 45 degrees between individual bellows, is available to effect the transfer of a label from the carrier to the end of an individual bellows. As a consequence, lower velocities of tape speeds are required and the transfer of labels to the ends of the individual bellows is more reliable, with fewer labels missing and with greater accuracy of placement. Additionally, the labeler is capable of higher speeds, because each individual bellows 38 need move through an arc of only 45 degrees, rather than 60 degrees as required by the prior art.

Turning now additionally to FIGS. 10–16, enhanced features of an embodiment of the bellows 38 are further described. The bellows 38 illustratively includes a venturi member 40 for applying or maintaining a vacuum to hold the label 41 to the bellows. As described above, the labeler includes a positioner for advancing each bellows 38 along a path of travel between a label pick-up position and a label application position, and a controller for controlling fluid flow to retract and extend the bellows as same is advanced along the path of travel.

The bellows 38 illustratively includes a cap 42 defining a distal end of the bellows for carrying the label 41 and having a plurality of cap openings 43 therein. The bellows 38 also includes a pleated sidewall 45 connected to the cap and having a plurality of sidewall openings 46 therein. More particularly, the sidewall openings are on a proximal face or side of the first pleat 45*a* adjacent the cap 42 as shown in the illustrated embodiment.

The venturi member 40 includes a first seal 47 which is positioned adjacent the cap 42 to define a first chamber 51 in communication with the cap openings 43. In the illustrated embodiment, the first seal 47 is formed of a rigid material, and may preferably be integrally formed with the venturi body 53. In other embodiments, the first seal 47 may be a separate annular piece mounted to the venturi body 53 as will be readily appreciated by those skilled in the art.

The venturi member 45 also illustratively includes a second seal 55 positioned adjacent the first seal 47 to define a second chamber 57 which may be in fluid communication with the sidewall openings 46 depending on whether the bellows is in the retracted or extended position as will be explained in greater detail below. The second seal 55 may be in the form of a flexible annular member received in a recess in the venturi body 53 as shown in the illustrated embodiment. As will be readily appreciated by those skilled in the art, the second seal 55 may be integrally formed with the venturi body 53 or may be mounted in a different arrangement in alternate embodiments of the invention.

Figure 11:
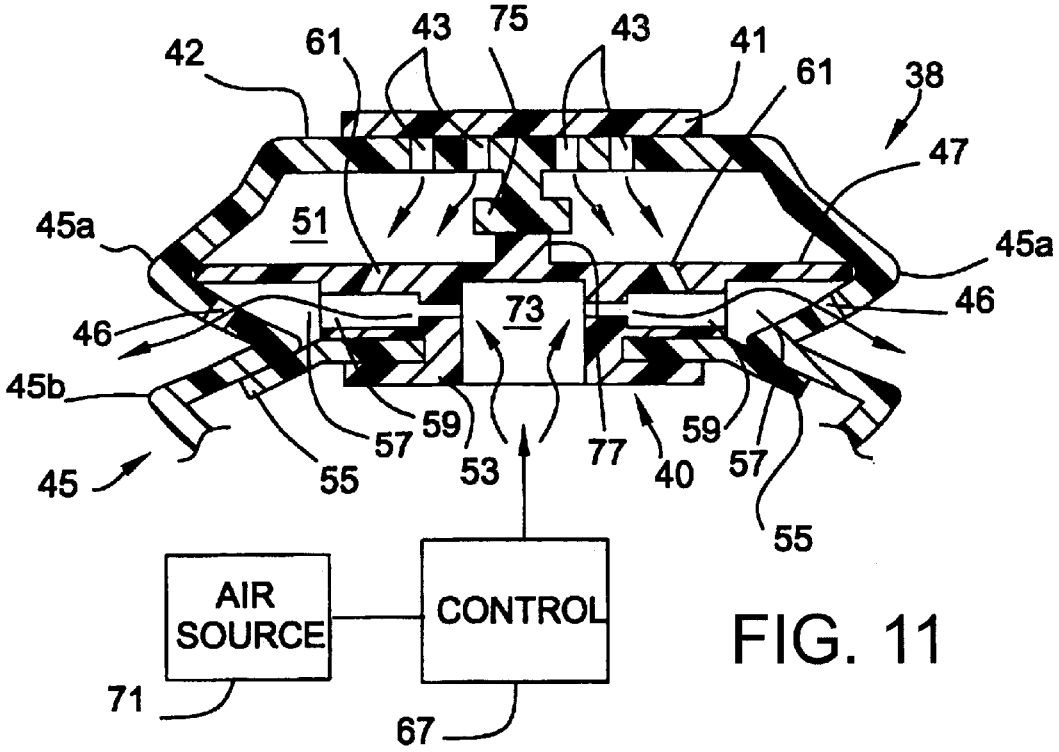
FIG. 11 is a cross-sectional view of the bellows portion as shown in FIG. 10 in the extended position.
Figure 12:
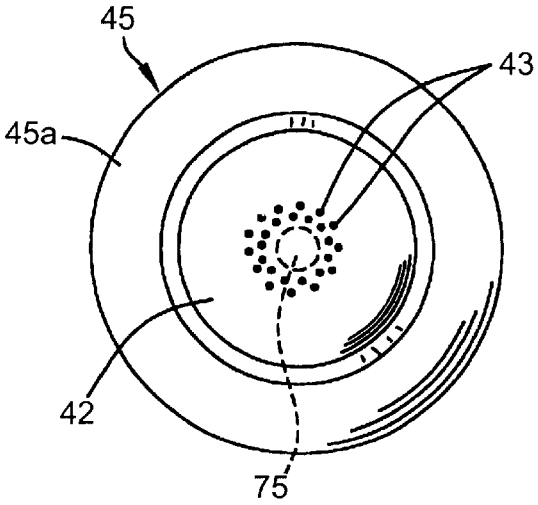
FIG. 12 is a top plan view of the distal end of the bellows without a label in position in accordance with the present invention.
Figure 13:
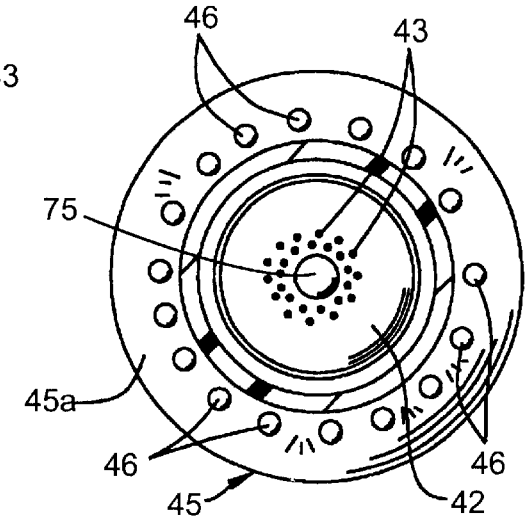
FIG. 13 is a cross-sectional view taken after the first pleat of the pleated sidewall of the bellows in accordance with the present invention.
Figure 14:
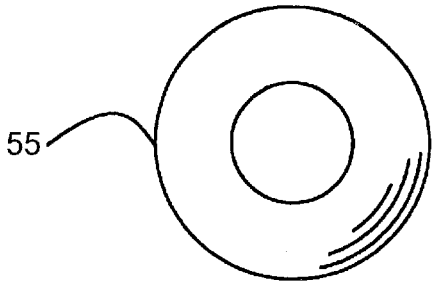
FIG. 14 is a top plan view of the flexible seal used in the bellows in accordance with the present invention.
Figure 15:
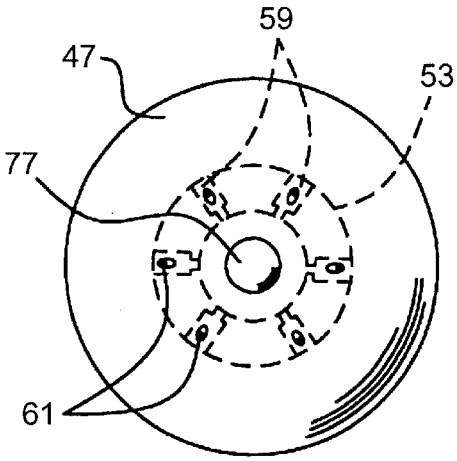
FIG. 15 is a top plan view of the venturi body and integrally formed seal of the bellows in accordance with the present invention.
Figure 16:
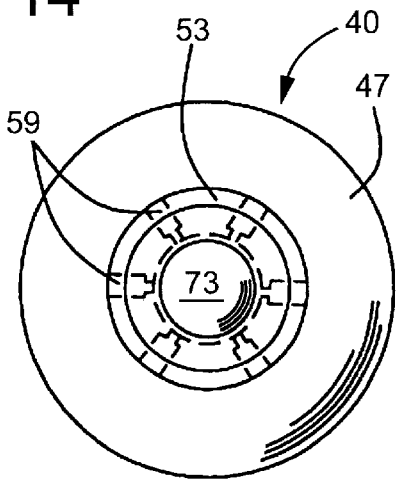
FIG. 16 is a bottom plan view of the venturi body as shown in FIG. 15.

The venturi body 53 also includes a plurality of passageways 59, 61 therein for generating a low pressure in the first chamber 51 and at the cap openings 43 caused by a venturi effect as air or other fluid flows from a proximal end of the bellows 38, into the second chamber 57, and out the sidewall openings 46 as seen perhaps best in FIG. 11. The venturi body 53 has a series of enlarged first passageways 59 connected in fluid communication between the proximal end of the bellows 38 and the second chamber 57. The venturi body 53 also has a series of constricted second passageways 61 connected in fluid communication between the first chamber 51 and respective ones of the series of enlarged first passageways 59. In the illustrated embodiment, the enlarged passageways 59 extend outwardly in a radial direction from a central opening or passageway 73, and the constricted passageways 61 are angled to couple to their respective radially extending enlarged passageways. As will be readily understood by those skilled in the art, the constricted passageways 61, as coupled to the flow of air through the enlarged passageways 59, creates the venturi effect. The venturi member 40 provides means for generating a low pressure adjacent the cap openings 43 while fluid flows into a proximal end of the bellows as the bellows is extended.

In slightly different terms, the venturi member 40 and its cooperating seals 47, 55 thereby assist in retaining the label 41 on the cap 42 as the bellows 38 is moved to the extended position during application of the label to the article as can be seen in FIG. 11, where the proximal end of the bellows is schematically coupled to the illustrated air source 65 via the controller 67. Accordingly, the placement of the label 41 onto the fruit is likely to be more accurate, and the label is less likely to be prematurely ejected from the cap 42 of the bellows 38. The operation of the air source 65 and controller 67 have been extensively described above and need no further description.

Figure 10:
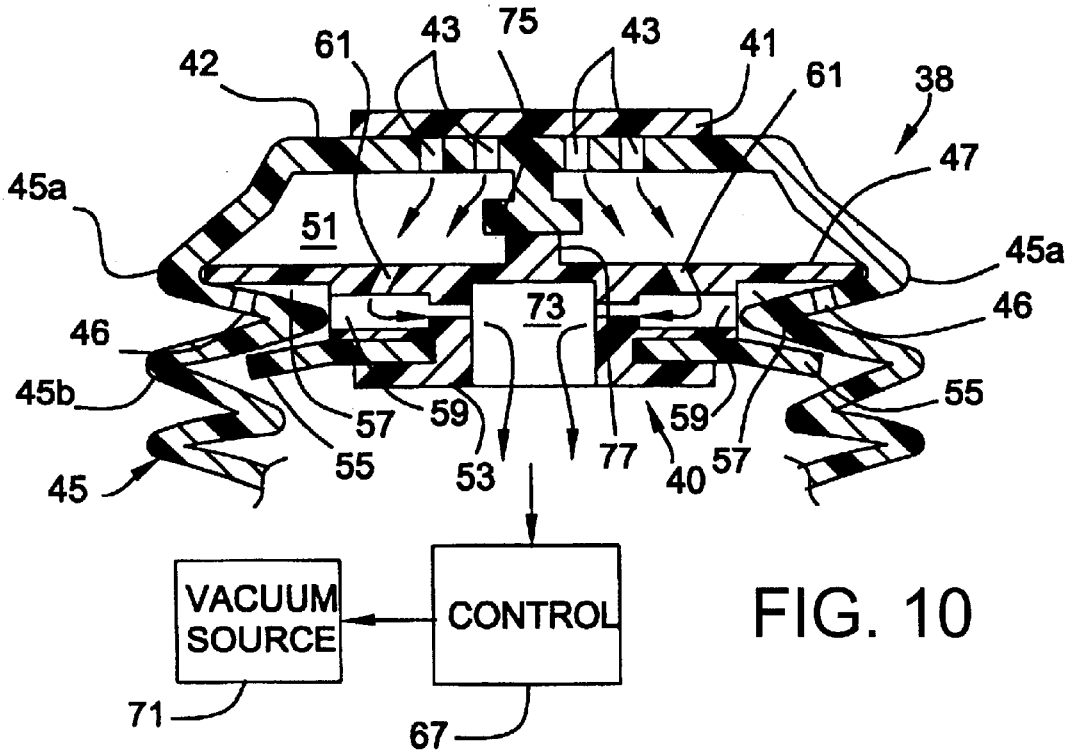
FIG. 10 is a cross-sectional view of a portion of the bellows in a retracted positioned and holding a label in accordance with the present invention.

Another advantageous feature of the bellows 38 is that the sidewall openings 46 are sealed by the first seal 47 when the bellows is in the retracted position as perhaps best understood with particular reference to FIG. 10. In other words, the first seal 47 and the sidewall openings 46 may preferably be relatively positioned so that the first seal covers the sidewall openings when the bellows is in the retracted position.

The reduced pressure or vacuum, when the bellows is in the retracted position, is communicated to the first chamber 51 via the passageways 59, 61 as will be readily appreciated by those skilled in the art. The reduced pressure or vacuum can be more readily maintained to thereby keep the bellows in the retracted position by closing the sidewall openings 46. In FIG. 10 the proximal end of the bellows 38 is schematically coupled to a vacuum or negative pressure source 71 via the controller 67.

A stop may be defined by a first member or projection 75 on the inside of the cap 42 and a second correspondingly aligned projection 77 on the venturi member 40. Thus, the first chamber 51 is prevented from collapsing, and perhaps blocking communication between the cap openings 43 and the constricted passageways 61 in the venturi body 53.

Peripheral portions of the first seal 47 may contact and sealingly engage outermost portions of the first pleat 45*a* adjacent the cap 42 as shown in the illustrated embodiment. The sidewall openings 46 extend through a proximal portion of the first pleat 45*a*, and the second seal 55 contacts and sealing engages a second pleat 45*b* adjacent the first pleat.

The bellows 38, including the venturi member 40, cap openings 43, and sidewall openings 46 overcomes the limitations of the prior art check valve and diaphragm arrangements. The prior art approaches were subject to becoming stuck in the open or closed position, such as caused by an accumulation of label adhesive and/or wax carried by the fruit. The bellows 38 in accordance with the present invention has no check valve associated with the cap openings 43 and no diaphragm to selectively cover the cap openings. Rather, vacuum can be applied to the cap openings 43 throughout the entire machine cycle as will be readily appreciated by those skilled in the art. The venturi member 40 permits the bellows 38 to be expanded by coupling to positive pressure, yet still provides a vacuum to the label 41 to maintain the label in the proper position until placed on the fruit.

A method aspect of the invention is for operating a bellows 38 movable between extended and retracted positions for applying labels to articles. The bellows 38 is preferably of a type comprising a cap 42 defining a distal end of the bellows for carrying the label 41 and having at least one cap opening 43 therein, and a pleated sidewall 45 connected to the cap and having at least one sidewall opening 46 therein. The method preferably comprises the step of generating a low pressure adjacent the at least one cap opening 43, while fluid flows into a proximal end of the bellows.

The step of generating preferably includes positioning a first seal 47 adjacent the cap 42 to define a first chamber 51 in communication with the at least one cap opening 43. The generating step also preferably includes positioning a second seal 55 adjacent the first seal to define a second chamber 57 capable of communicating with the at least one sidewall opening 46. Moreover, the generating step also preferably includes connecting a venturi body 53 to the first and second seals. The venturi body 53 preferably has a plurality of passageways 59, 61 therein for generating a low pressure in the first chamber 51 and at the at least one cap opening 43 caused by a venturi effect as fluid flows from a proximal end of the bellows, into the second chamber, and out the at least one sidewall opening. The venturi effect assists in retaining the label 41 on the cap 42 as the bellows is moved to the extended position during application of the label to the article. The step of positioning the first seal 47 preferably positions the first seal relative to the at least one sidewall opening 46 so that the first seal covers the at least one sidewall opening when the bellows is in the retracted position.

Figure 17:
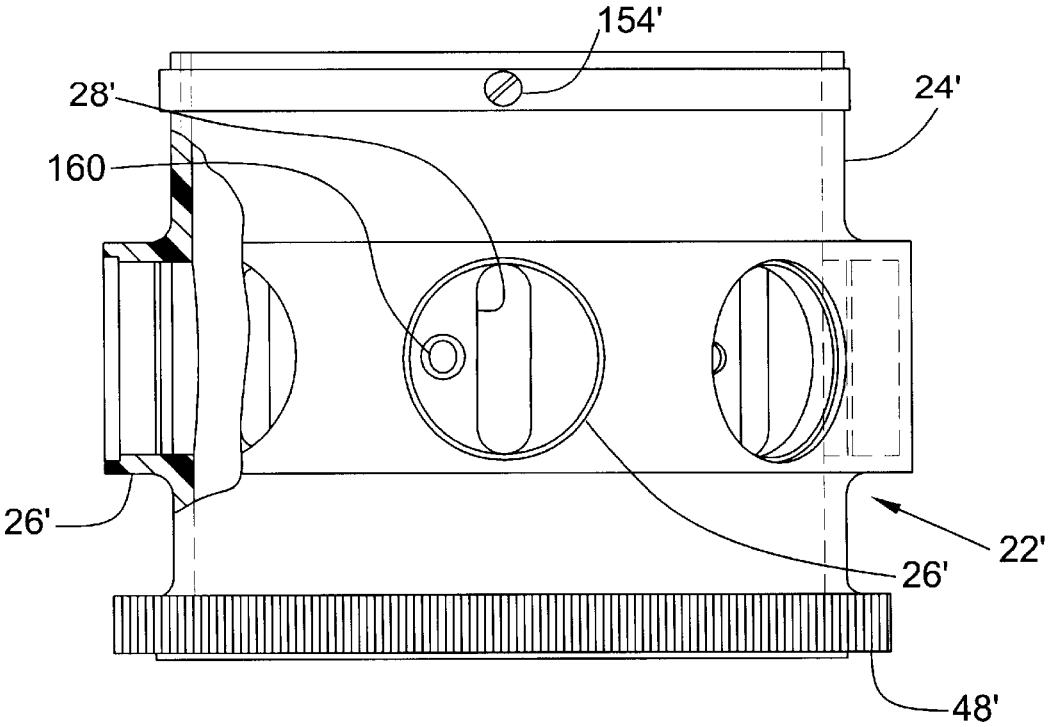
FIG. 17 is a top plan view of a bellows wheel of another embodiment illustrated with the bellows removed to show an arrangement of openings therein in accordance with the invention.

Turning now more specifically to FIGS. 17–20 another embodiment of a labeler or labeling apparatus in accordance with the present invention is now described. A modified bellows wheel 22' and bellows 165 are used in this embodiment. More particularly, as shown in FIG. 17, an opening 160 is provided adjacent the opening or slot 28' within the region defined by the bellows mounting projection 26'. The operation of the slot 28' and opening 160 will be described in greater detail below.

Figure 18:
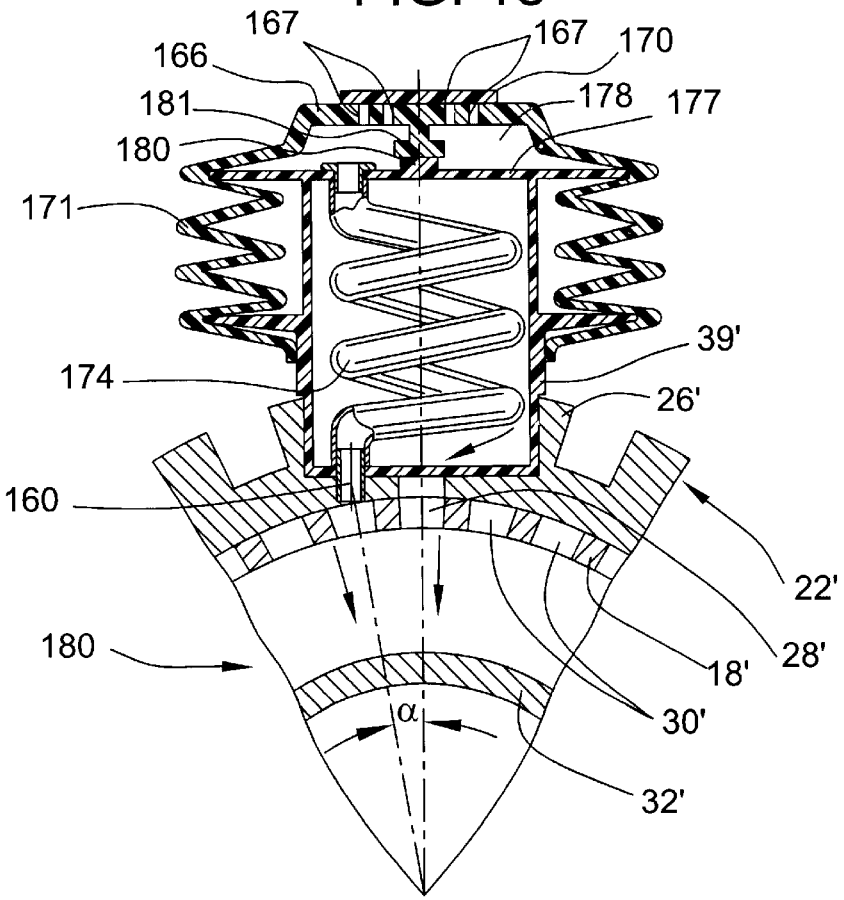
FIG. 18 is a cross-sectional view of a portion of the bellows wheel and bellows as in the embodiment of FIG. 17 with the bellows in a label pick-up position.
Figure 19:
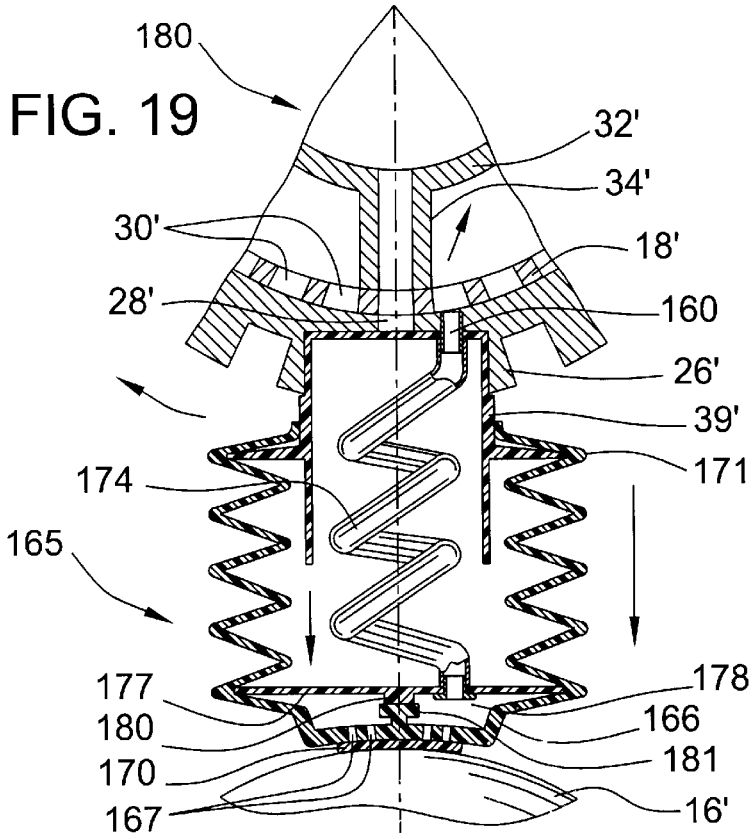
FIG. 19 is a cross-sectional view of the portion of the bellows wheel and bellows as in FIG. 18 rotated to a label applying position.
Figure 20:
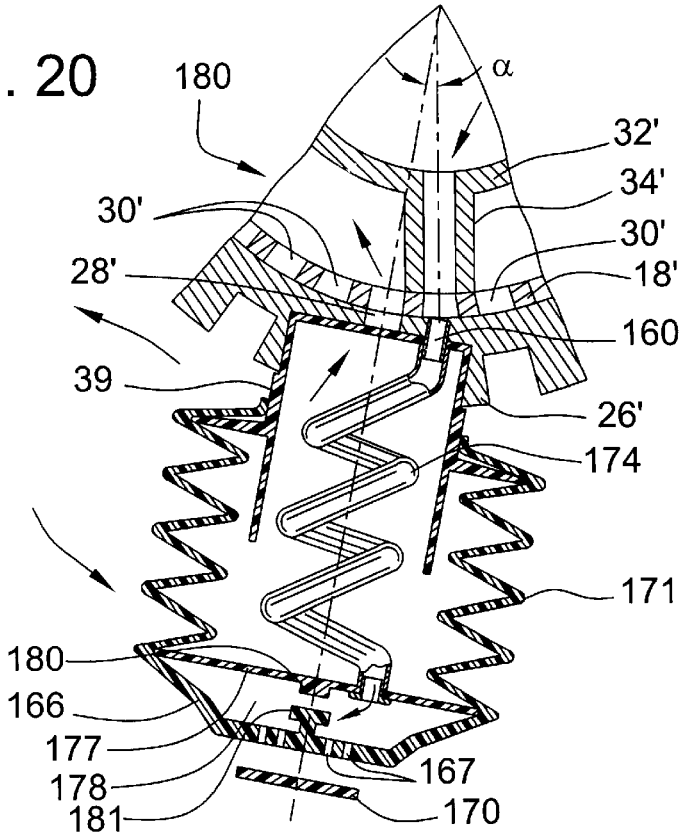
FIG. 20 is a cross-sectional view of the portion of the bellows wheel and bellows as in FIG. 19 rotated to a position downstream from the label applying position and illustrating ejection of a stuck label.

The bellows 165, of course, is also movable between extended and retracted positions responsive to positive and negative internal fluid pressure, respectively. For clarity of illustration, only a single bellows 165 is shown in FIGS. 18–20, although those of skill in the art will appreciate that the bellows wheel 22' can carry a plurality of bellows as extensively described above.

The bellows 165 comprises a cap 166 defining a distal end for carrying the label 170 and the cap has at least one cap opening 167 therein. The bellows 165 also includes a pleated sidewall 171 connected to the cap 166. The pleated sidewall 171 permits the bellows to move between the extended and retracted positions responsive to internal fluid pressure as will be readily appreciated by those skilled in the art.

A flexible coil tube 174 is positioned within the bellows 165. The flexible coil tube 174 has a distal end connected in fluid communication with the cap openings 167 and a proximal end to be selectively connected to negative and positive fluid pressure. Accordingly, the coil tube 174 can be used to provide vacuum at the distal end of the bellows 165 to retain the label 170. Moreover, the coil tube 174 can be used to supply a positive pressure through the cap openings 167 to ensure that a sticking label will not be carried back to the label application position, such as when the label is not correctly applied to the fruit 16'. This advantageous function is perhaps best shown in FIG. 20 which shows the bellows 165 rotated past the label application position (FIG. 19) and well before the label pick-up position (FIG. 18). In the position of FIG. 20, the flexible coil tube 174 is connected to positive fluid pressure as will be described in greater detail below.

The flexible coil tube 174 provides a number of significant advantages over the prior art approaches using check valves or diaphragms. A check valve or diaphragm valve may readily become gummed and rendered inoperative by the accumulation of label adhesive or fruit wax, for example. Such valves may become gummed shut or open, thereby rendering the valve inoperative. In addition, even a clean check valve or diaphragm valve has a tendency to leak air when the bellows is connected to positive pressure to extend the bellows. Accordingly, the air leakage has a tendency to blow the label from the end of the bellows prematurely as the bellows is being extended.

As will be readily appreciated by those skilled in the art, the bellows wheel 22' in the illustrated embodiment serves as a rotatable frame, or more broadly a positioner, for advancing the bellows along a path of travel between the label pick-up position (FIG. 17) and the label application position (FIG. 19). Other configurations of bellows mounting arrangements and positioners are also contemplated by the present invention as will be readily understood by those skilled in the art.

The illustrated labeler includes a fluid pressure manifold 180 defining a plurality of negative pressure ports 30' and at least one positive pressure port defined by the cross tube 34' (FIGS. 19 and 20) therein. In the illustrated embodiment, the fluid pressure manifold 180 is provided by the inner tube 32' and the surrounding outer tube 18'. The inner tube 32' is connected to a source of positive air pressure, and the outer tube 18' is connected to a source of vacuum in the illustrated embodiment. For example, and as described above, the inlet and outlet of an air blower may be used to provide the negative and positive air pressures coupled to the fluid pressure manifold 180.

The bellows wheel 22' surrounds the fluid pressure manifold 180, and the bellows wheel has a series of spaced apart first and second openings therein. The first openings are the slotted openings 28' and the second openings are defined by the openings 160 adjacent the slotted openings and within the respective projections 26' for each bellows 165. As the bellows wheel 22' is rotated, the bellows 165 is movable between extended and retracted positions responsive to coupling to positive and negative fluid pressure, respectively. The bellows 165 is subjected to negative pressure or vacuum when the slots or openings 28' are in registry with the vacuum ports 30'. Conversely, the bellows 165 is moved to the extended position when the slot or opening 28' is in registry with the positive pressure port as will be readily understood by those skilled in the art.

The flexible coil tube is similarly selectively connected to positive and negative fluid pressure. The flexible coil tube 174 is positioned within the bellows 165 and has a distal end connected in fluid communication with the cap openings 167 and a proximal end connected separately from the bellows to the corresponding second opening 160 positioned adjacent the slotted opening 28'. Accordingly, rotation of the bellows wheel 22' about the fluid pressure manifold 180 advances each of the bellows along a path of travel between the label pick-up position (FIG. 18) and the label application position (FIG. 19). This rotation selectively aligns vacuum openings 30 in the outer tube 18' with the second openings 160 in the bellows wheel 22' to thereby connect the flexible coil tube 174 to vacuum to retain the label 170 in position on the distal end of the bellows.

Rotation past the label application position to the position as shown in FIG. 20 aligns the opening 160 with the positive pressure port defined by the cross tube 34' to thereby momentarily couple the cap openings 167 to the positive pressure to blow debris or a stuck label from the end of the bellows. In the illustrated embodiment, the angle of rotation difference $\alpha$ between the slot 28' and the second opening 160 is about 11 degrees. Of course, this angle can be varied depending, for example, on the number of bellows 165 carried by the bellows wheel 22'.

The interior of each bellows 165 is preferably connected to vacuum along the entire path including the label pick-up position (FIG. 18), but is connected to positive pressure at the label application position as shown in FIG. 19 to thereby extend the bellows. More particularly, the cross tube 34' communicates the positive pressure to the bellows 165 when the bellows is directed downward toward the fruit 16'.

The flexible coil tube 174, bellows 165 and pressure coupling arrangement permit the flexible coil tube to also assist the bellows in returning to the retracted position. This is so because the coil tube 174 may preferably be formed of a material having a shape memory to bias the tube to return to the tightly coiled position, and the tube is normally coupled to a vacuum except when needed to clear debris from the end of the bellows 165. As will readily be appreciated by those skilled in the art, the flexible coil tube 174 may be formed of any of a number of conventional plastic tubing materials, for example.

As shown in the illustrated embodiment, coils of the flexible coil tube 174 preferably define a longitudinal axis extending along a direction of extension and retraction of the associated bellows 165. As also shown in the illustrated embodiment, coils of the flexible coil tube 174 are preferably positioned within the rigid mounting cup 39' when the bellows 165 is in the retracted position as shown in FIG. 18. This helps to define a compact retracted position for the rotating bellows 165 to thereby ensure adequate clearance from adjacent portions of the labeler.

A partition member 177 is illustratively positioned in an interior portion of the bellows 165 adjacent the distal end thereof defining a distal end chamber 178 in fluid communication with the cap opening 167. In addition, the distal end of the flexible coil tube 174 is connected in fluid communication with the distal end chamber 178. The partition member 177 may be positioned to extend into and seal against a first pleat of the pleated sidewall 171 of the bellows 165 adjacent the cap 166 thereof as shown in the illustrated embodiment.

Yet another aspect of this embodiment of the invention relates to a positive stop feature of the invention as perhaps best understood with reference to FIG. 18. In particular, stop means may be provided within the distal end chamber 178 for defining a first positive stop between the partition member 177 and the cap 166. The stop means is provided by a first projection 180 on the partition member 177 and a second mating stop 181 integrally formed into the interior face of the bellows cap 166. In addition, the rigid mounting cup 39' also includes outermost portions which extend into a proximal end of the bellows 165 and contact the partition member 177 when the bellows is in the retracted position to define a second positive stop. Of course, the positive stop features of the invention also provide for the compact and secure positioning of the rapidly rotating bellows 165 in the retracted position to thereby ensure adequate clearance from adjacent portions of the labeler.

Figure 21:
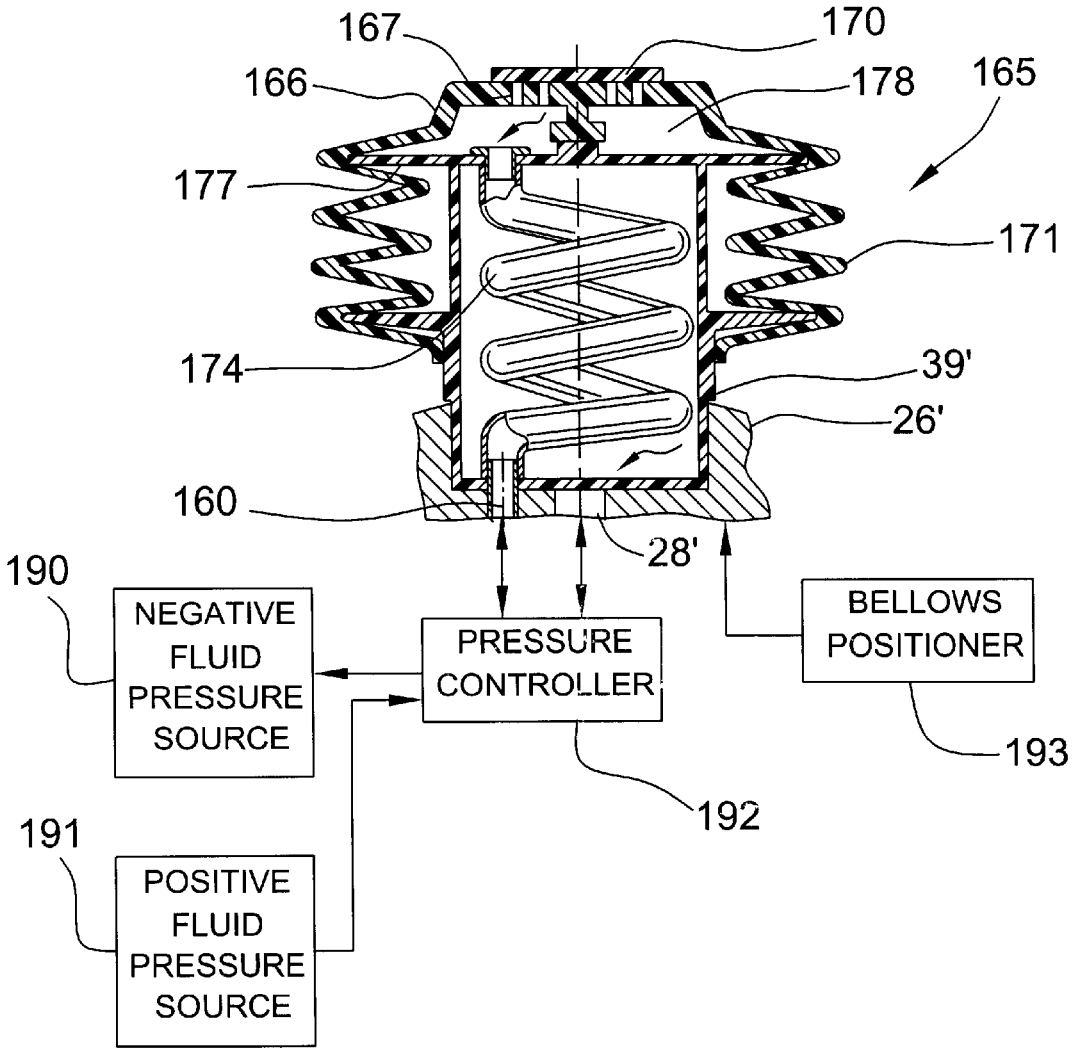
FIG. 21 is a schematic and partial cross-sectional view of another embodiment of a labeler in accordance with the invention.

Turning now additionally to FIG. 21, a more generic labeler variation is described based upon the embodiment of the bellows 165 and coil tube 174 described above with respect to FIGS. 17–20. In this illustrated version, a vacuum or negative fluid pressure source 190 and a positive fluid pressure source 191 are provided. The negative or positive fluid pressure is selective coupled by the pressure controller 192 to the opening 28' to the bellows interior, and the opening 160 connected to the cap openings 167 by the flexible coil tube 174. This selective pressure coupling is carried out as the bellows positioner 193 moves the bellows 165 along its predetermined path of travel. Of course, multiple bellows 165 could be so positioned and pressure thereto controlled as will be readily appreciated by those skilled in the art.

The pressure controller 192 may include means for, during a first time, connecting the bellows 165 to positive fluid pressure, while connecting the proximal end of the flexible coil tube 174 to negative pressure to retain the label 170 as the bellows is moved to the extended position. The pressure controller 192 may also include means for, during a second time period after the first time period, connecting the proximal end of the flexible coil tube 174 to positive fluid pressure, while connecting the bellows 165 to negative fluid pressure to expel a label not applied to an article as the bellows is moved to the retracted position. The pressure controller 192 may be provided by the mechanical arrangement of manifold ports and openings as described above, or may include electrically and or mechanically controlled valves coordinated with operation of the bellows positioner 193. The positioner 193 may be provided by the stepper motor and rotatable frame or bellows wheel described above, or by other mechanical, hydraulic, electrical or pneumatic positioners as will also be readily appreciated by those skilled in the art. Accordingly, the flexible coil tube 174 may be used to apply vacuum to hold the label against the end of the bellows, and to apply positive pressure to clear the cap openings 167, such as to expel a stuck label.

Another aspect of the invention relates to a method for making a label applying apparatus comprising at least one bellows 165 movable between extended and retracted positions responsive to positive and negative fluid pressure as described above with reference to FIGS. 17 to 21. The bellows 165 preferably comprises a cap 166 defining a distal end for carrying the label and having at least one cap opening 167 therein, and a pleated sidewall 171 connected to the cap. The method preferably comprises the steps of forming a flexible coil tube 174, and positioning the flexible coil tube within the at least one bellows and connecting a proximal end of the flexible coil tube in fluid communication with the at least one cap opening.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A labeling apparatus for applying labels to articles comprising:

a rotary bellows wheel having a plurality of radially-spaced expandable bellows wherein rotation of the bellows wheel cycles each bellows between a label pick-up position and a label application position;

each bellows having a distal bellows end for carrying a label which has a distal bellows end opening therein and being expandable when subjected to pressure;

a respective flexible coil tube arranged within each bellows, the flexible coil tube having a distal end in fluid communication with the distal bellows end opening;

a partition member positioned in an interior portion of each of the bellows adjacent the distal end thereof defining a distal end chamber in fluid communication with the distal bellows end opening; and wherein the distal end of the flexible coil tube is in fluid communication with the distal end chamber; and a pressure controller for selectively applying pressure and vacuum to each of the bellows and separately to each of the respective flexible coil tubes as the bellows wheel rotates.

2. A labeling apparatus according to claim 1 wherein coils of each of the flexible coil tubes define a longitudinal axis extending along a direction of extension and retraction of the corresponding bellows.

3. A labeling apparatus according to claim 1 wherein each of the flexible coil tubes comprises a material having a shape memory so that the flexible coil tube biases the corresponding bellows toward a retracted position.

4. A labeling apparatus according to claim 1 further comprising a stop surface within the distal end chamber for defining a first positive stop between the partition member and the distal bellows end.

5. A labeling apparatus according to claim 4 further comprising a respective rigid mounting cup extending into a proximal end of each of the bellows; and wherein the rigid mounting cup includes outermost portions contacting the partition member when the corresponding bellows is in a retracted position to define a second positive stop.

6. A labeling apparatus according to claim 5 wherein coils of the flexible coil are positioned within the rigid mounting cup when the corresponding bellows is in the retracted position.

7. A labeling apparatus according to claim 1 wherein the pressure controller operates to subject each flexible tube to vacuum as the respective bellows moves from the label pick-up to the label application position so as to retain a label on the distal bellow end and to pressure when the respective bellows is in a third position after the bellows has past the label application position and before the bellows returns to the label pick-up position in order to clear any debris from the distal bellows end.

8. A labeling apparatus for applying labels to articles and comprising:

a fluid pressure manifold defining a pressure port and a plurality of vacuum ports therein;

a rotatable bellows wheel surrounding the fluid pressure manifold and having a series of spaced apart first and second openings therein;

a plurality of bellows carried by the rotatable bellows wheel, each bellows being connected to a corresponding first opening in the rotatable bellows wheel and being movable between extended and retracted positions responsive to pressure and vacuum applied at the corresponding first opening each of the bellows having a distal bellows end for carrying a label which has a distal bellows end opening therein;

a respective flexible coil tube positioned within each bellows and having a distal end in fluid communication with the distal bellows end opening and a proximal end in fluid communication with a corresponding second opening in the rotatable bellows wheel; and a partition member positioned in an interior portion of each of the bellows adjacent the distal end thereof defining a distal end chamber in fluid communication with the distal bellows end opening; and wherein the distal end of the flexible coil tube is in fluid communication with the distal end chamber, wherein rotation of the bellows wheel about the fluid pressure manifold cycles each of the bellows between a label pick-up position and a label application position, and for each bellows selectively aligns the pressure port with the corresponding first opening in the bellows wheel so that the bellows is subjected to pressure adjacent the label application position and for each bellows aligns at least one of the vacuum ports with the corresponding second opening in the bellows wheel so that the corresponding flexible coil tube is connected to negative pressure when the respective bellows is in the label application position.

9. A labeling apparatus according to claim 8 wherein coils of each of the flexible coil tubes define a longitudinal axis extending along a direction of extension and retraction of the corresponding bellows.

10. A labeling apparatus according to claim 8 wherein each of the flexible coil tubes comprises a material having a shape memory so that the flexible coil tube biases the corresponding bellows toward a retracted position.

11. A labeling apparatus according to claim 8 further comprising a stop surface within the distal end chamber for defining a first positive stop between the partition member and the distal bellows end.

12. A labeling apparatus according to claim 11 further comprising a respective rigid mounting cup extending into a proximal end of each of the bellows; and wherein the rigid mounting cup includes outermost portions contacting the partition member when the corresponding bellows is in a retracted position to define a second positive stop.

13. A labeling apparatus according to claim 12 wherein coils of the flexible coil are positioned within the rigid mounting cup when the corresponding bellows is in the retracted position.

14. A labeling apparatus according to claim 8 wherein rotation of the bellows wheel about the fluid pressure manifold for each bellows aligns the pressure port with the corresponding second openings in the bellows wheel so that the corresponding flexible coil tube is connected to pressure when the bellows is in a third position after the bellows has past the label application position and before the bellows returns to the label pick-up position in order to clear any debris from the distal bellows end.

15. A labeling apparatus for applying labels to articles comprising:

an expandable bellows which moves between a label pick-up position and a label application position;

the bellows having a distal bellows end for carrying a label which has a distal bellows end opening therein and being expandable when subjected to pressure;

a respective flexible coil tube arranged within the bellows, the flexible coil tube having a distal end in fluid communication with the distal bellows end opening;

a partition member positioned in an interior portion of the bellows adjacent the distal end thereof defining a distal end chamber in fluid communication with the distal bellows end opening; and wherein the distal end of the flexible coil tube is in fluid communication with the distal end chamber; and a pressure controller for selectively applying pressure and vacuum to the bellows and separately to the flexible coil tube as the bellows moves between the label pick-up and the label application positions.

16. A labeling apparatus according to claim 15 further comprising a stop surface within the distal end chamber for defining a first positive stop between the partition member and the distal bellows end.

17. A labeling apparatus according to claim 16 further comprising a respective rigid mounting cup extending into a proximal end of each of the bellows; and wherein the rigid mounting cup includes outermost portions contacting the partition member when the corresponding bellows is in a retracted position to define a second positive stop.

18. A labeling apparatus according to claim 15 wherein the flexible coil tube comprises a material having a shape memory so that the flexible coil tube biases the bellows toward a retracted position.

19. A labeling apparatus according to claim 15 wherein the bellows is carried on a rotatable bellows wheel and the bellows moves between the label pick-up and label application positions through rotation of the bellows wheel.

* * * * *